US011322816B2

(12) United States Patent
Xie et al.

(10) Patent No.: US 11,322,816 B2
(45) Date of Patent: May 3, 2022

(54) FEEDING DEVICE

(71) Applicant: Huawei Technologies Co., Ltd., Shenzhen (CN)

(72) Inventors: Qingming Xie, Shanghai (CN); Gaonan Zhou, Xi'an (CN); Qiuyan Liang, Xi'an (CN); Jianping Zhao, Shanghai (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 110 days.

(21) Appl. No.: 16/726,455

(22) Filed: Dec. 24, 2019

(65) Prior Publication Data

US 2020/0136226 A1 Apr. 30, 2020

Related U.S. Application Data

(63) Continuation of application No. PCT/CN2017/090037, filed on Jun. 26, 2017.

(51) Int. Cl.
*H01P 5/16* (2006.01)
*H01P 5/02* (2006.01)
(Continued)

(52) U.S. Cl.
CPC ..... *H01P 5/16* (2013.01); *H01P 5/026* (2013.01); *H01P 5/028* (2013.01); *H01P 5/085* (2013.01); *H01P 5/1007* (2013.01)

(58) Field of Classification Search
CPC .... H01Q 25/008; H01Q 21/0031; H01Q 3/40; H01P 5/16; H01P 5/026; H01P 5/085;
(Continued)

(56) References Cited

U.S. PATENT DOCUMENTS 4,490,723 A 12/1984 Hardie et al.
5,936,588 A 8/1999 Rao et al.
(Continued)

FOREIGN PATENT DOCUMENTS

CN 1249086 A 3/2000
CN 1943077 A 4/2007
(Continued)

OTHER PUBLICATIONS

Cohn, S.B., "A Class of Broadband Three-Port TEM-Mode Hybrids," IEEE Transactions on Microwave Theory and Techniques, vol. MTT-16, No. 2, Feb. 1, 1968, pp. 110-116.
(Continued)

*Primary Examiner* — Stephen E. Jones
*Assistant Examiner* — Kimberly E Glenn
(74) *Attorney, Agent, or Firm* — Slater Matsil, LLP

(57) ABSTRACT

A feeding device is disclosed. The feeding device includes a body and at least one first port, the body includes at least one first contour port, and each of the at least one first contour port corresponds to one of the at least one first port; and the first contour port includes at least two sub-ports, and the at least two sub-ports of the first contour port are connected, by using at least one power splitter, to the first port corresponding to the first contour port. In the foregoing implementation solution, the first contour port is divided into several sub-ports, and the first port and the several sub-ports are connected by using the at least one power splitter.

20 Claims, 5 Drawing Sheets

(51) Int. Cl.
*H01P 5/08* (2006.01)
*H01P 5/10* (2006.01)

(58) Field of Classification Search
CPC .. H01P 5/1004; H01P 25/008; H01P 21/0031; H01P 3/40
See application file for complete search history.

(56) References Cited

U.S. PATENT DOCUMENTS

| | | | | |
|---|---|---|---|---|
| 7,724,197 | B1 | 5/2010 | Hardie et al. | |
| 9,715,609 | B1 * | 7/2017 | Fink | H04B 5/0062 |
| 2007/0212008 | A1 | 9/2007 | Schoebel | |
| 2013/0214974 | A1 | 8/2013 | Nagaishi et al. | |
| 2014/0218264 | A1 | 8/2014 | Kawate | |
| 2015/0263424 | A1 | 9/2015 | Sanford et al. | |

FOREIGN PATENT DOCUMENTS

| | | | |
|---|---|---|---|
| CN | 101076741 | A | 11/2007 |
| CN | 101707289 | A | 5/2010 |
| CN | 102403576 | A | 4/2012 |
| CN | 103459034 | A | 12/2013 |
| CN | 103532604 | A | 1/2014 |
| CN | 103918127 | A | 7/2014 |
| CN | 104091990 | A | 10/2014 |
| CN | 105281042 | A | 1/2016 |
| CN | 106257748 | A | 12/2016 |
| CN | 106662750 | A | 5/2017 |
| EP | 0517187 | A2 | 12/1992 |
| EP | 0793291 | A2 | 9/1997 |
| EP | 2372835 | A1 | 10/2011 |
| EP | 2713442 | A1 | 4/2014 |
| JP | H05231937 | A | 9/1993 |
| JP | H08316702 | A | 11/1996 |
| JP | 2010154522 | A | 7/2010 |
| JP | 2013201686 | A | 10/2013 |
| KR | 20130078298 | A | 7/2013 |

OTHER PUBLICATIONS

Zhang, Y., "Principle and Application of Electronic Warfare Power Synthesis Technology", 1997, 5 pages.

* cited by examiner

FEEDING DEVICE

CROSS-REFERENCE TO RELATED APPLICATIONS

This application is a continuation of International Application No. PCT/CN2017/090037, filed on Jun. 26, 2017, the disclosure of which is hereby incorporated by reference in its entirety.

TECHNICAL FIELD

This application relates to the field of communications technologies, and in particular, to a feeding device.

BACKGROUND

With continuous upgrading of mobile communications systems, multi-beam, miniaturization, and the like become main factors of modern antenna design. A multibeam communications network is a main technology that implements a multibeam antenna using spatial selectivity. Advantages such as spatial multiplexing, interference mitigation, and the like may be brought by using a spatial selectivity method. Currently, in the multibeam communications network, a Rotman lens is a mainly used feeding device. The Rotman lens has features such as a high bandwidth, being capable of being designed in a plane, and irrelevance between a beam direction and frequency. However, the Rotman lens has a relatively high insertion loss.

SUMMARY

Embodiments of this application provide a feeding device, to reduce an insertion loss of the feeding device.

According to a first aspect, an embodiment of this application provides a feeding device, where the feeding device includes a body and at least one first port, the body includes at least one first contour port, and each of the at least one first contour port corresponds to one of the at least one first port; and the first contour port includes at least two sub-ports, and the at least two sub-ports of the first contour port are connected, by using at least one power splitter, to the first port corresponding to the first contour port.

In the foregoing implementation solution, the first contour port is divided into several sub-ports, where a feeding width of each sub-port is less than an original feeding width of the first contour port, and the first port and the several sub-ports are connected by using the at least one power splitter. Therefore, returned energy is less, and signals are more uniformly fed into the body, so that miniaturization of the body and a low insertion loss are achieved.

In a specific implementation solution, the feeding device further includes at least one second port, the body further includes at least one second contour port, and each of the at least one second contour port corresponds to one of the at least one second port; and the second contour port and the second port corresponding to the second contour port are connected by using a stepped impedance transformation structure. Therefore, energy returning to the body is less, and the insertion loss of the body is reduced.

In a specific implementation solution, a length a of each step of impedance structure in the stepped impedance transformation structure in a direction in which the second contour port points to the second port meets: the length a is a quarter of a wavelength corresponding to a central frequency of an operating frequency band of the feeding device.

In a specific implementation solution, the stepped impedance transformation structure is a microstrip stepped impedance transformation structure, a strip line stepped impedance transformation structure, or a coaxial line stepped impedance transformation structure, such as a stepped impedance transformation structure that is produced using a microstrip.

In a specific implementation solution, a redundant port is further disposed on the body, where the redundant port is disposed between two first contour ports; or the redundant port is disposed between the first contour port and the second contour port. Isolation between the contour ports is increased using the redundant port.

In a specific implementation solution, the power splitter is a microstrip power splitter, a strip line power splitter, or a coaxial line power splitter.

In a specific implementation solution, the feeding device further includes at least one third port, the body further includes at least one third contour port, and each of the at least one third contour port corresponds to one of the at least one third port; and the third contour port and the third port corresponding to the third contour port are connected by using a horn-shaped impedance converter.

DETAILED DESCRIPTION OF ILLUSTRATIVE EMBODIMENTS

Figure 1:
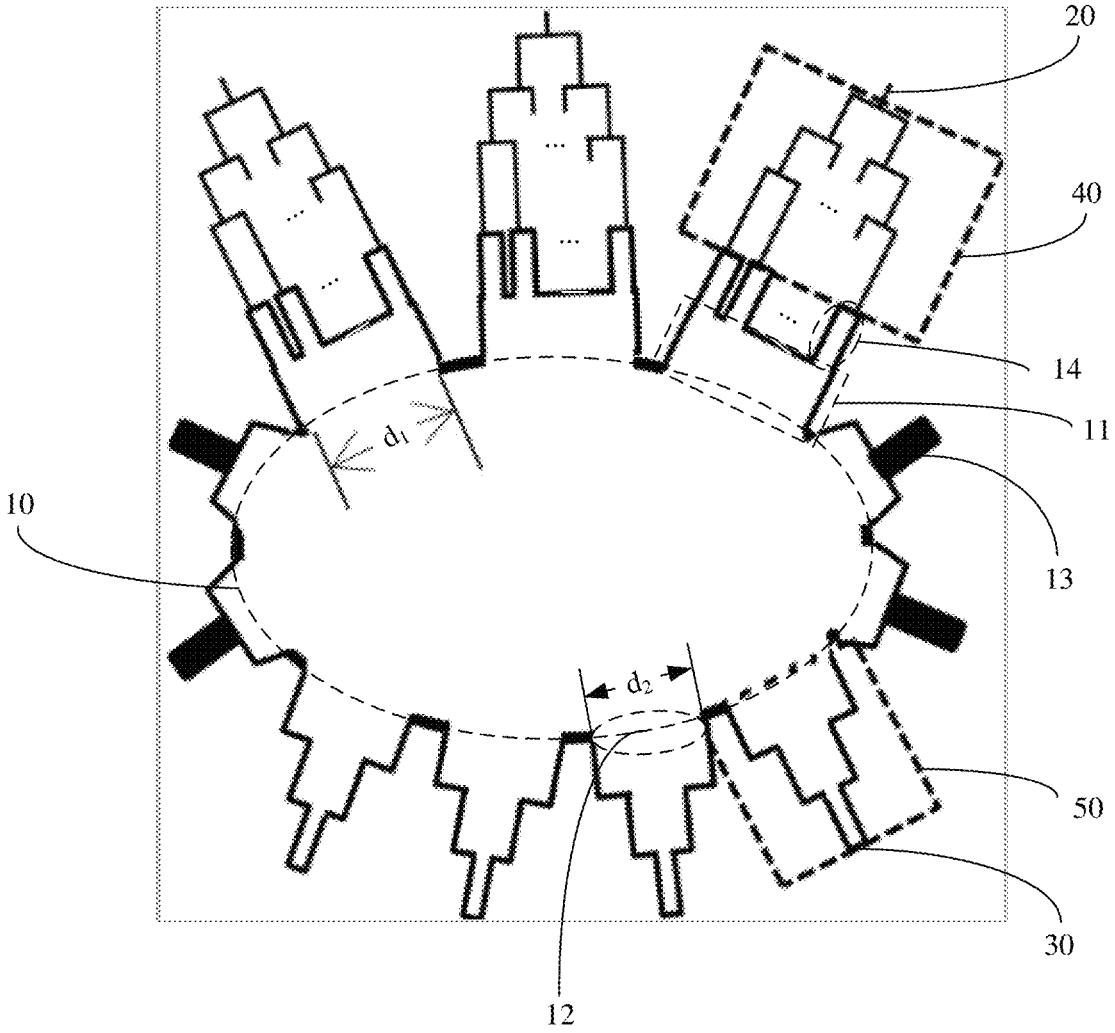
FIG. 1 is a schematic structural diagram of a feeding device according to an embodiment of this application.

The following describes the technical solutions in the embodiments of this application with reference to the accompanying drawings in the embodiments of this application.

In this application, the term "a plurality of" refers to two or more, and other quantifiers are similar. The term "and/or" describes an association relationship between associated objects and represents that three relationships may exist. For example, A and/or B may represent the following three cases: only A exists, both A and B exist, and only B exists.

The character "/" generally indicates an "or" relationship between the associated objects.

An embodiment of this application provides a feeding device, and the feeding device includes a body and at least one port. Optionally, the port may be an input port and/or output port of the feeding device. Correspondingly, a contour port corresponding to each port is disposed on the body. In descriptions of this application, the contour port may be a specific port, or may be a feeding section. For example, the contour port may be an arc-shaped section on the body, or the contour port may be an irregular feeding section on the body. This is not limited herein. Each port and the contour port corresponding to the port are connected. In a possible implementation, each port and the contour port corresponding to the port are connected by using a component.

In this embodiment of this application, a contour port of the feeding device may include at least two sub-ports, and the at least two sub-ports are connected to a port using at least one power splitter. In descriptions of this application, the sub-port may be a specific port, or may be a feeding section. This is not limited herein. The feeding device in this embodiment of this application may effectively reduce an occupied area of the feeding device. Therefore, miniaturization of the feeding device is achieved. Optionally, the at least one power splitter is connected in a cascading manner, such as two-level cascading and three-level cascading. This application constitutes no limitation on a quantity of the power splitters and a quantity of cascaded levels of the power splitters. Furthermore, the feeding device in this embodiment of this application may enable returning energy to be less, and signals to be more uniformly fed into the body.

To accurately describe various ports corresponding to the contour ports, in the embodiments of this application, a first port and a second port are used as an example for description. The first port may be an input port or an output port of the feeding device. When there is a plurality of first ports, some first ports may serve as the input ports of the feeding device, and some first ports may serve as the output ports of the feeding device. Specific effects of the first port depend on a scenario in which the feeding device is used. The second port may be an output port or an input port of the feeding device. When there is a plurality of second ports, some second ports may serve as the input ports of the feeding device, and some second ports may serve as the output ports of the feeding device. In a possible implementation, if the body has both the first port and the second port, when the first port serves as the input port of the feeding device, the second port serves as the output port of the feeding device; or when the first port serves as the output port of the feeding device, the second port serves as the input port of the feeding device. The two ports may be used based on a practical requirement. In a possible implementation, when there is a plurality of first ports and second ports, some first ports and second ports may serve as the input ports of the feeding device, and some first ports and second ports may serve as the output ports of the feeding device.

In a possible implementation, the feeding device is a Rotman lens.

For ease of understanding the feeding device provided in this embodiment, the following uses a feeding device shown in FIG. 1 as an example for description. The feeding device includes a body 10, a plurality of first ports 20, and a plurality of second ports 30. The body 10 includes first contour ports 11 corresponding to the plurality of first ports 20, and a plurality of second contour ports 12 corresponding to the second port 30. The at least one first port 20 is an input port of the feeding device. At least one second port 30 is an output port of the feeding device. The first contour ports 11 corresponding to the plurality of first ports 20 are contour input ports. The second contour ports 12 corresponding to the plurality of second ports 30 are contour output ports. Each contour input port corresponds to at least two sub-ports 14. In the feeding device shown in FIG. 1, the first contour ports 11 are protruding rectangular structures that have a length $d_1$ on the body 10, and the second contour ports 12 are arc-shaped sections that have a length $d_2$ on the body 10. $d_1$ is a waveguide wavelength $\lambda g$ (the waveguide wavelength is a wavelength of an electromagnetic wave that is propagated in a waveguide). Specifically, the wavelength is a signal wavelength of an operating frequency band of the feeding device, such as a signal wavelength of a central frequency band.

For the feeding device shown in FIG. 1, the body 10 is of an oval structure. Optionally, the body 10 may further be of another shape, such as a rectangular or irregular shape. The feeding device shown in FIG. 1 includes three first ports 20 and four second ports 30, and the first ports and the second ports are disposed on two sides of a long axis of the body 10. There are three first contour ports 11 corresponding to the first ports 20, and four second contour ports corresponding to the second ports 30. This application constitutes no limitation on a quantity of the first ports and a quantity of the second ports. The quantity of the first ports 20 and the quantity of the second ports 30 may be set based on a practical requirement, and the quantity of the first ports 20 and the quantity of the second ports 30 may be the same or different.

In the feeding device shown in FIG. 1, each first contour port 11 includes at least two sub-ports 14, and the at least two sub-ports 14 are connected to the first port 20 by using a cascaded power splitter 40. In an embodiment of this application, the sub-port 14 is a specific rectangular port. Optionally, the sub-port 14 may further be a feeding section. This is not limited herein. Each second contour port 12 is connected to each second port 30 by using a stepped impedance transformation structure 50. During propagation, signals are input into the body 10 through the first port 20, and then output through the second port 30.

Specific implementations of the first contour ports 11 (namely, the contour input port) and the second contour ports 12 (namely, the contour output port) shown in FIG. 1 may be interchangeable. To be specific, the first contour ports 11 may be arc-shaped sections that have a length $d_1$ on the body 10, and the second contour ports 12 may be a protruding rectangular structures that have a length $d_2$ on the body 10. Certainly, the contour input ports 11 or the contour output ports 12 provided in this application may alternatively be another specific implementation. This is not limited in this application.

In a possible implementation, when signals are propagated, the feeding device divides each first contour port 11 on the body 10 into at least two sub-ports 14, that is, each first contour port 11 includes at least two sub-ports 14. When there are two sub-ports 14, the two sub-ports 14 are connected to the first port 20 by using a power splitter 40. When there is a plurality of sub-ports, the plurality of sub-ports 14 are connected, using the cascaded power splitter 40, to the first port 20 corresponding to the first contour port 11. In a structure shown in FIG. 1, each first contour port 11 includes eight sub-ports 14 (FIG. 1 skips showing all the sub-ports, but only uses four sub-ports as an example), and the eight sub-ports 14 are connected to the first port 20 by using a three-level cascaded power splitter 40. Specifically, the first port 20 is connected to a power splitter, two branches of the power splitter are each connected to a two-level power splitter, two branches of each two-level power splitter are each connected to a three-level power splitter, and two branches of each three-level power splitter are each connected to a sub-port 14, so that the first port 20 is connected to each sub-port 14. It can be learned from the foregoing descriptions that the power splitter used in this embodiment is a one-two power splitter, and each power splitter uniformly divides signals into two branches.

It should be understood that FIG. 1 shows the three-level cascaded power splitter 40, that is, the three-level cascaded power splitter 40 shown in the figure includes a plurality of cascaded power splitters. However, in a specific setting, the cascaded power splitter 40 may be a two-level cascaded power splitter 40, a three-level cascaded power splitter 40, or a four-level cascaded power splitter 40. By using the foregoing cascading manner, a requirement for reducing an insertion loss may be met, and a case in which excessively many cascaded power splitters occupy relatively large space may also be effectively avoided. Therefore, a size of the feeding device may be effectively reduced.

The power splitter 40 may be a microstrip power splitter, a strip line power splitter, or a coaxial line power splitter. A microstrip power splitter is used in this embodiment.

In the foregoing embodiment, several power splitters 40 are used to feed signals into the contour input port in an equal phase. By using a connection manner in which the power splitter 40 feeds power, returning energy is less, and signals are more uniformly fed into the body. In addition, using the connection manner in which the cascaded power splitter 40 is used, an occupied area of the feeding device is effectively reduced. Therefore, miniaturization of the feeding device is achieved.

Figure 3:
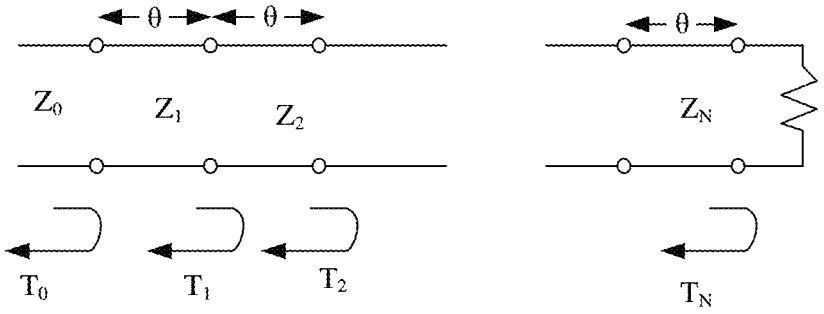
FIG. 3 is a schematic diagram of Chebyshev impedance transformation.

To implement feeding device broadband, a Chebyshev impedance transformation is used on each power splitter. The Chebyshev impedance transformation is a relatively great broadband impedance transformation in which a return loss is little. As shown in FIG. 3, the Chebyshev impedance transformation is used to match $Z_0$ with $Z_L$, where $\theta=\lambda g/4$, and the return loss is little. $T_0, \ldots,$ and $T_N$ and $Z_1, \ldots,$ and $Z_N$ may be deduced by using a Chebyshev comprehensive formula, where $T_0, \ldots,$ and $T_N$ each represent a return coefficient at different locations, $Z_1, \ldots,$ and $Z_N$ each represent an impedance of each branch (as shown in FIG. 3), and $\lambda g$ is a waveguide wavelength.

Figure 2:
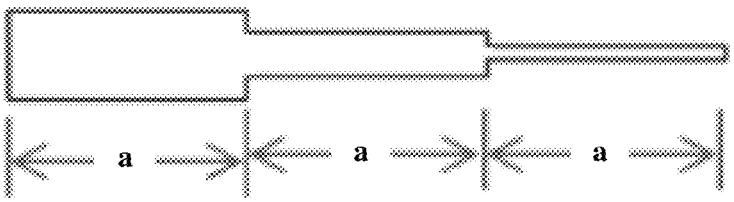
FIG. 2 is a schematic structural diagram of a stepped impedance transformation structure according to an embodiment of this application.

In a possible implementation, to further improve performance of the feeding device provided in this embodiment, each second contour port 12 and the second port 30 corresponding to the second contour port 12 are connected using the stepped impedance transformation structure 50, that is, the second port 30 is connected to the second contour port 12 by using the stepped impedance transformation structure. The stepped impedance transformation structure 50 is an impedance transformation structure which has gradually increased impedances in a direction in which the second contour port 12 points to the second port 30. The stepped impedance transformation structure 50 is a microstrip stepped impedance transformation structure, a strip line stepped impedance transformation structure, or a coaxial line stepped impedance transformation structure. With reference to FIG. 2, the stepped impedance transformation structure 50 is a three-level stepped impedance transformation structure 50. Optionally, a length a of each step of impedance structure in the stepped impedance transformation structure 50 in the direction in which the second contour port 12 points to the second port 30 meets: the length a is a quarter of a wavelength corresponding to a central frequency of an operating frequency band of the feeding device.

In the foregoing embodiment, by using the stepped impedance transformation structure 50 between the second port 30 and the second contour port 12, energy that returns to a contour is less. Therefore, the return loss of the output port is reduced.

In a possible implementation, as shown in FIG. 1, a plurality of redundant ports 13 are disposed on the body 10 provided in this embodiment. The redundant ports 13 may be disposed between two neighboring first contour ports 11, to improve isolation of the input ports. That is, the redundant ports 13 may be disposed between two neighboring first contour ports 11, and each redundant port 13 is connected to one resistor and is grounded, or is connected to a plurality of resistors in parallel and is grounded. Therefore, the redundant port may absorb an electromagnetic wave that is propagated to the redundant port, and electromagnetic wave reflection is avoided. When one resistor is used and the redundant port 13 is grounded, the resistor is a resistor with low resistance. When a plurality of resistors in parallel are used, the plurality of resistors may use resistors with high resistance, and the plurality of resistors with high resistance in parallel may amount to a resistor with low resistance. For example, the redundant port 13 is connected to a 50 Ohm resistor and is grounded. In this case, when a resistor with low resistance is used, the resistance of the resistor with low resistance is 50 Ohms, and when the plurality of resistors with high resistance in parallel are used, the resistance of the plurality of resistors with high resistance in parallel amounts to 50 Ohms. In this manner, miniaturization of the feeding device is achieved, energy that returns to the second port 30 is reduced, and therefore, return loss of the port is reduced.

In a possible implementation, the redundant port 13 may further be disposed between the first contour port 11 and the second contour port 12. The redundant port 13 may reduce unnecessary electromagnetic reflection on the feeding device, and a signal transmission disorder may be caused when excessively much electromagnetic reflection is reduced. A quantity of the redundant ports 13 that are disposed between the first contour port 11 and the second contour port 12 may be selected based on a requirement, such as one or two or three redundant ports 13. As shown in FIG. 1, two redundant ports 13 are disposed between the first contour port 11 and the second contour port 12 that are neighboring to each other.

For ease of understanding the feeding device provided in this embodiment, the following describes an electromagnetic model of the feeding device provided in an embodiment of this application.

Figure 4:
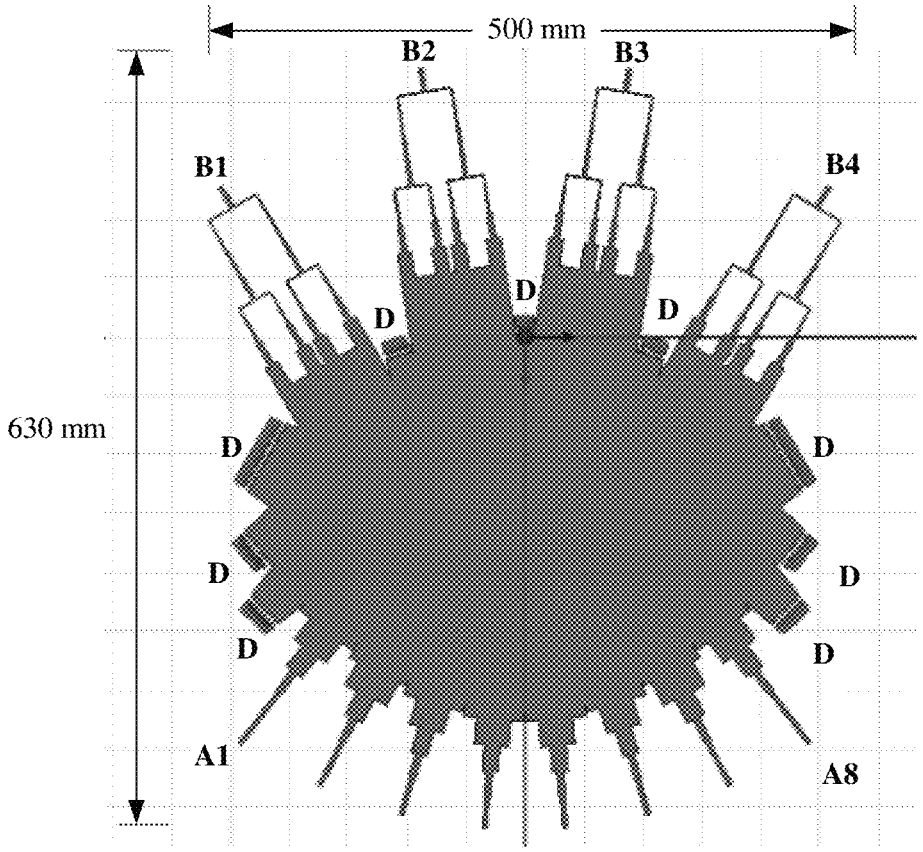
FIG. 4 is a diagram of an electromagnetic model of a feeding device according to an embodiment of this application.

FIG. 4 shows an electromagnetic model of the feeding device according to an embodiment of this application. It should be noted that B1 to B4 of the feeding device are input ports, A1 to A8 are output ports, and D is a redundant port. As shown in FIG. 4, a body of the feeding device provided in this embodiment of this application is connected to the input ports and the output ports by using a stepped impedance transformation structure. In the foregoing structure, a size of the feeding device is: a length 500 mm (horizontally), and a width 630 mm (vertically). However, a feeding device in the prior art has a relatively large size, usually has a length 860 mm (horizontally), and a width 940 mm (vertically). Therefore, the size of the feeding device narrows from 940 mm×860 mm to 630 mm×500 mm in this application, an area is largely reduced. In this way, the feeding device provided in this embodiment may reduce an occupied area of the feeding device to a relatively large extent.

Figure 5:
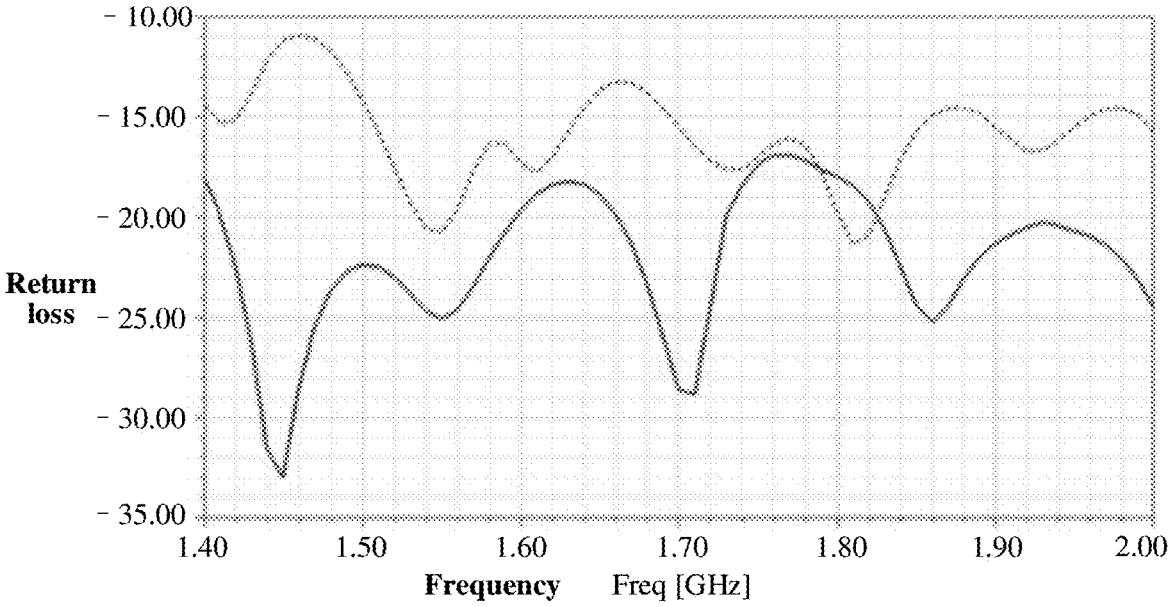
FIG. 5 is a return loss diagram of a B2 input port shown in FIG. 4.
Figure 6:
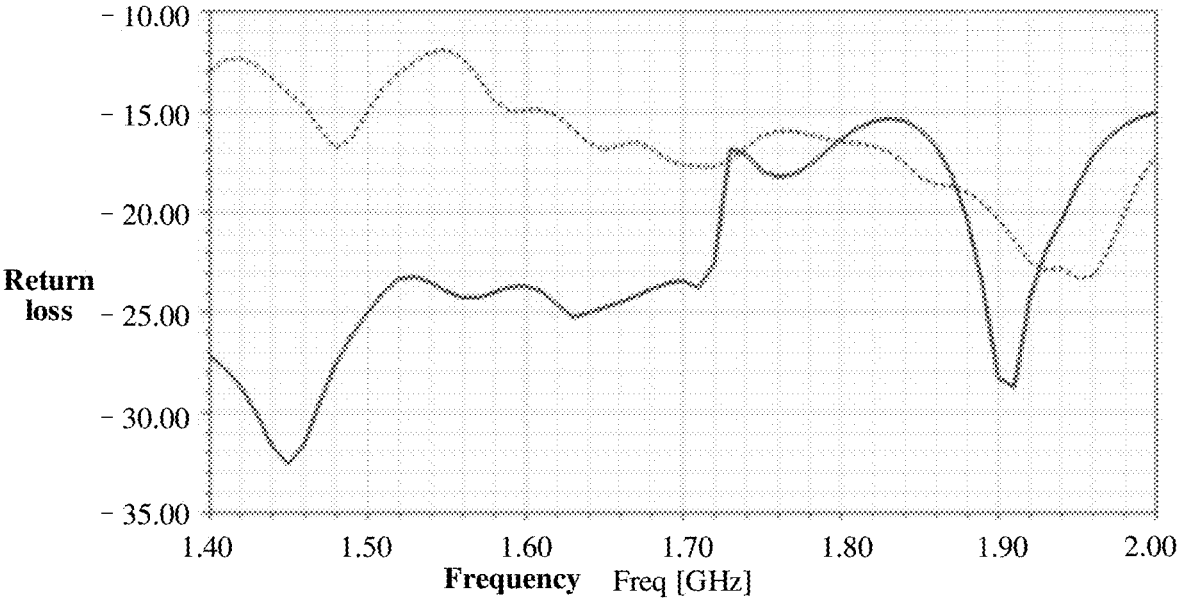
FIG. 6 is a return loss diagram of a B4 input port shown in FIG. 4.
Figure 7:
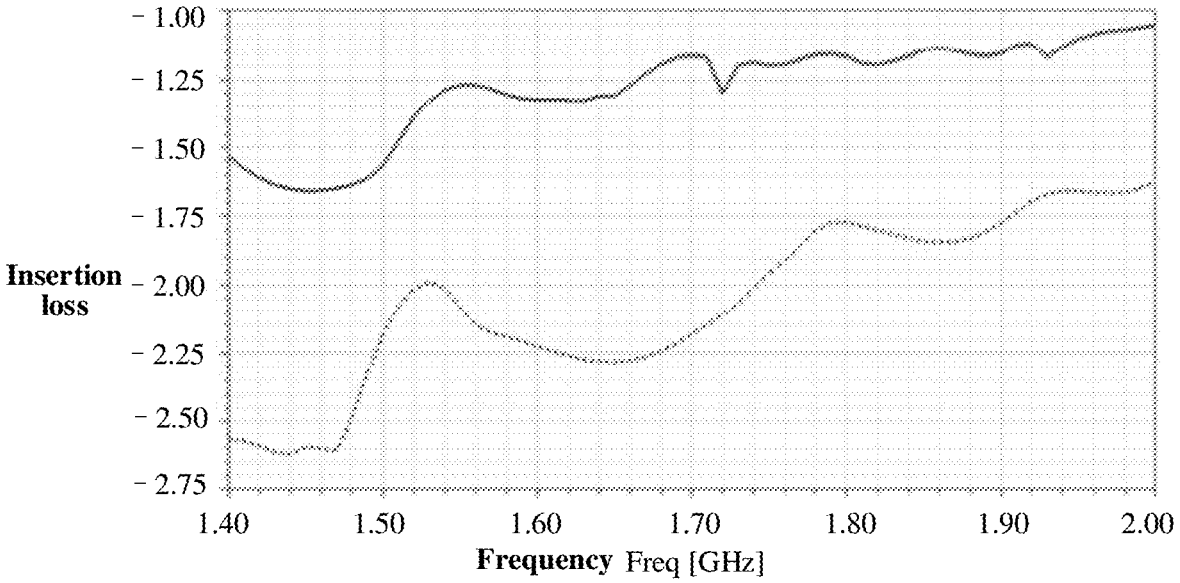
FIG. 7 is an insertion loss diagram of a B2 input port shown in FIG. 4.
Figure 8:
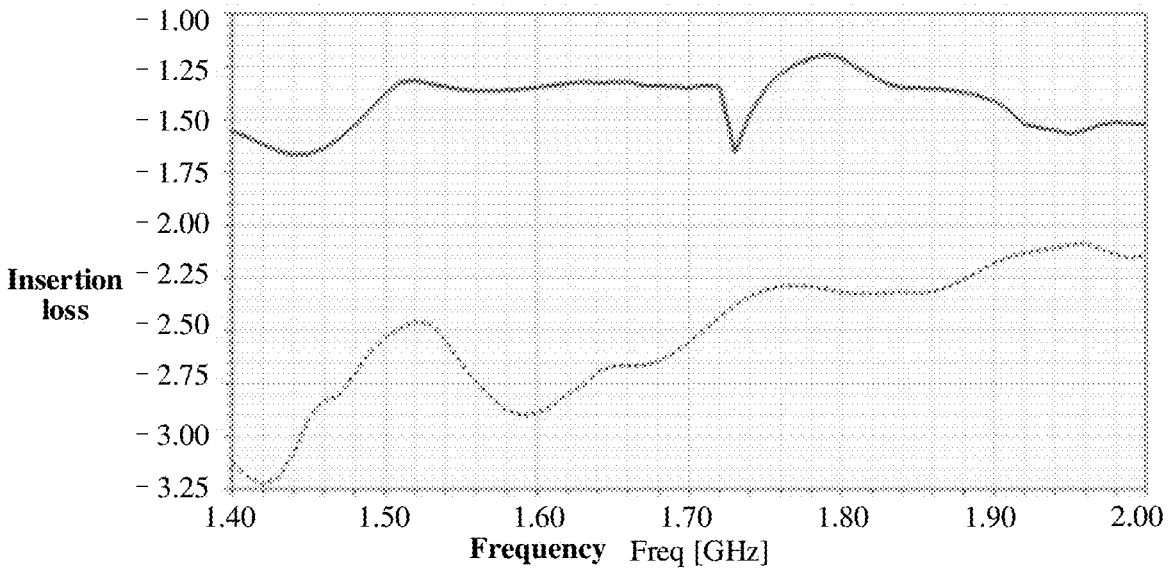
FIG. 8 is an insertion loss diagram of a B4 input port shown in FIG. 4.

The electromagnetic model of the feeding device shown in FIG. 4 is used as an example for electromagnetic simulation. A condition of the simulation is that the feeding device provided in this embodiment of this application has a same area and a same operating frequency band with the feeding device in the prior art. Main circuit indicators to consider a bandwidth characteristic of the feeding device are a return loss and an insertion loss. As shown in FIG. 4, B1 and B4, and B2 and B3 are fully symmetric. Therefore, electromagnetic simulation is performed on B2 and B4, and simulation results are shown in FIG. 5 to FIG. 8. FIG. 5 is a return loss comparison diagram of the B2 input port. FIG. 6 is a return loss comparison diagram of the B4 input port. FIG. 7 is an insertion loss comparison diagram of the B2 input port. FIG. 8 is an insertion loss comparison diagram of the B4 input port. In FIG. 5 to FIG. 8, a dashed line represents a simulation result of the feeding device in the prior art, and a full line represents a simulation result of the feeding device provided in this embodiment of this application. It can be learned from the simulation results in FIG. 5 to FIG. 8 that the feeding device provided in this embodiment of this application between the input port and a contour input port is divided into a plurality of branches to feed power, and uses the stepped impedance transformation structure between the output port and a contour output port. Therefore, in a frequency range from 1.4 GHz to 2 GHz, the entire feeding device reduces a relatively large port return loss (≤−15 dB), and an overall insertion loss of the B1/B2/B3/B4 port is reduced by 1 dB.

It can be learned from the foregoing embodiment that the feeding device provided in this application effectively reduces an occupied space area and the insertion loss.

It should be understood that, in the foregoing embodiments, although the first port serves as the input port of the feeding device, and the second port serves as the output port of the feeding device, the first port may also serve as the output port of the feeding device and the second port may also serve as the input port of the feeding device, or some first ports serve as the input ports of the feeding device and some first ports serve as the output ports of the feeding device; or some second ports serve as the input ports of the feeding device and some second ports serve as the output ports of the feeding device. Principles thereof are similar to the foregoing specific embodiments, and details are not described herein again.

In a possible implementation, the feeding device provided in this embodiment of this application further includes at least one third port, the body further includes at least one third contour port, and each of the at least one third contour port corresponds to one of the at least one third port; and the third contour port and the third port corresponding to the third contour port are connected by using a horn-shaped impedance converter. Specifically, in a first case, the feeding device includes the first port and the third port, and correspondingly, the first contour port and the third contour port are disposed on the body. In a second case, the feeding device includes the first port, the second port, and the third port, and correspondingly, the first contour port, the second contour port, and the third contour port are disposed on the body.

Figure 9:
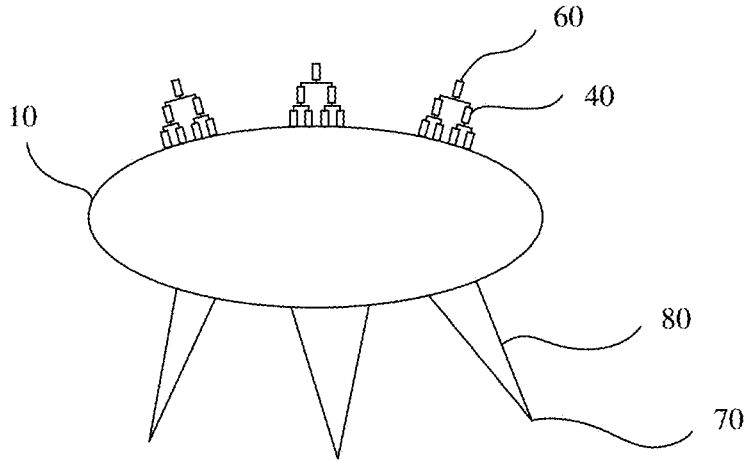
FIG. 9 is a schematic structural diagram of another feeding device according to an embodiment of this application.

First, for the first case, as shown in FIG. 9, a feeding device includes a body 10 and two types of ports that are first ports 60 and third ports 70. The first ports 60 are input port of the feeding device, and the third ports 70 are output ports of the feeding device. For the first ports 60, refer to the foregoing descriptions of the input ports of the feeding device that uses FIG. 1 as an example, and details are not described herein again. Still referring to FIG. 9, in this embodiment, contour output ports are connected to the third port 70 by using horn-shaped impedance converters 80, and the horn-shaped impedance converters may also be referred to as triangular impedors. The third ports 70 in this embodiment may be practical ports, or may be sections of the horn-shaped impedance converters 80. This is not limited in this application. In this case, it can be understood as that the first ports of the feeding device are connected to the first contour ports using power splitters 40, and the third contour ports are connected to the third ports using the triangular impedors. It can be learned from the foregoing descriptions that the first ports 60 are connected to sub-ports of the first contour ports using the power splitters 40, an occupied area of the feeding device may be effectively reduced, and an insertion loss may be effectively reduced. In addition, a redundant port may also be disposed on the feeding device. The redundant port may be disposed between any two contour input ports (the first contour ports); or may be disposed between the contour input port (the first contour port) and the contour output port (the third contour port). Effects of the redundant port are the same as the effects of the redundant port described in the foregoing embodiments, and details are not described herein again.

Figure 10:
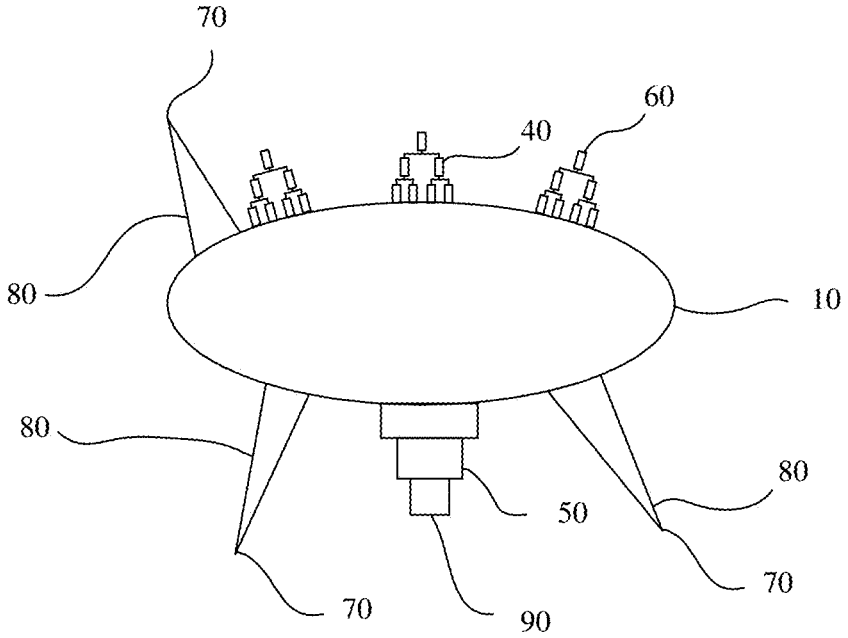
FIG. 10 is a schematic structural diagram of another feeding device according to an embodiment of this application.

It should be understood that, in a structure shown in FIG. 10, although the first ports 60 serve as the input ports of the feeding device and the third ports 70 serve as the output port of the feeding device, different situations may exist. For example, a first port 60 may also serve as the output port of the feeding device and a third port 70 may serve as the input port of the feeding device. Alternatively, when there are a plurality of first ports 60 and third ports 70, some first ports 60 serve as the input ports of the feeding device, and some first ports 60 serve as the output ports of the feeding device. Alternatively, some third ports 70 serve as the input ports of the feeding device, and some third ports 70 may serve as the output ports of the feeding device.

For the second case, as shown in FIG. 10, a feeding device includes a body 10 and three ports that are a first port 60, a second port 90, and a third port 70. Correspondingly, a first contour port, a second contour port, and a third contour port are disposed on the body 10.

The first port 60 serves as an input port of the feeding device, the second port 90 serves as an output port of the feeding device, and the third port 70 may serve as the input port of the feeding device or the output port of the feeding device. Correspondingly, the first contour port serves as a contour input port, the second contour port serves as a contour output port, and the third contour port may serve as the contour input port or the contour output port. The first port 60 is connected to the first contour port by using a plurality of power splitters, and the second port 90 is connected to the third contour port by using a stepped impedance transformation structure 50. For descriptions of the connection manner and effects thereof, refer to the descriptions of the input port and the output port of the feeding device shown in FIG. 1, and details are not described herein again. Regardless of serving as the input port or the output port, the third port 70 is connected to the third contour port by using a horn-shaped impedance converter 80. The connection manner is the same as a connection manner between an input port and a contour input port in a feeding device in the prior art, and details are not described herein again.

A redundant port may also be disposed on the feeding device. The redundant port may be disposed between any two contour input ports (the first contour port and the first contour port, or the first contour port and the third contour port); or may be disposed between the contour input port (the first contour port or the third contour port) and the contour output port (the second contour port or the third contour port). Effects of the redundant port are the same as the effects of the redundant port described in the foregoing embodiments, and details are not described herein again.

It can be learned from the foregoing descriptions that the input port is connected to sub-ports of the contour input port by using the power splitter 40, an occupied area of the feeding device may be effectively reduced, and an insertion loss may be effectively reduced.

It should be understood that, in a structure as shown in FIG. 10, although the first port 60 serves as the input port, the second port 90 serves as the output port of the feeding device, and the third port 70 may serve as the output port of the feeding device or the input port of the feeding device, another form may be used. For example, the input port and the output port may use any port of the first port 60, the second port 90, and the third port 70, and details are not described herein again.

Obviously, a person skilled in the art can make various modifications and variations to the embodiments of this application without departing from the spirit and scope of this application. This application is intended to cover these modifications and variations provided that they fall within the scope of protection defined by the following claims and their equivalent technologies.

What is claimed is:

1. A feeding device, comprising:

a body, comprising a first contour port protruding from a surface of the body, wherein the first contour port comprises a plurality of sub-ports extending from a side of the first contour port that faces away from the body; and a first port, wherein the first contour port corresponds to the first port, and the plurality of sub-ports of the first contour port are connected, using a power splitter, to the first port, the power splitter being disposed between the first contour port and the first port.

2. The feeding device according to claim 1, further comprising:

a second port; and wherein the body further comprises a second contour port, the second contour port corresponds to the second port, and the second contour port and the second port are connected using a stepped impedance transformation structure.

3. The feeding device according to claim 2, wherein a length a of each step of impedance structure in the stepped impedance transformation structure in a direction in which the second contour port points to the second port meets the following:

the length a is a quarter of a wavelength corresponding to a central frequency of an operating frequency band of the feeding device.

4. The feeding device according to claim 2, wherein the stepped impedance transformation structure is a microstrip stepped impedance transformation structure.

5. The feeding device according to claim 2, wherein the stepped impedance transformation structure is a strip line stepped impedance transformation structure.

6. The feeding device according to claim 2, wherein the stepped impedance transformation structure is a coaxial line stepped impedance transformation structure.

7. The feeding device according to claim 2, wherein the body further comprises a redundant port, and the redundant port is disposed between the first contour port and the second contour port.

8. The feeding device according to claim 1, wherein the body further comprises a redundant port, and the redundant port is disposed between the first contour port and another first contour port.

9. The feeding device according to claim 8, wherein the power splitter is a microstrip power splitter.

10. The feeding device according to claim 8, wherein the power splitter is a strip line power splitter.

11. The feeding device according to claim 8, wherein the power splitter is a coaxial line power splitter.

12. The feeding device according to claim 1, further comprising:

a third port;

wherein the body further comprises a third contour port, the third contour port corresponds to the third port, and the third contour port and the third port are connected using a horn-shaped impedance converter.

13. A feeding device, comprising:

a body, comprising a plurality of first contour ports protruding from a surface of the body, wherein each first contour port of the plurality of first contour ports comprises a respective plurality of sub-ports extending from a side of the corresponding first contour port that faces away from the body; and a plurality of first ports, wherein each first contour port of the plurality of first contour ports corresponds to a respective first port of the plurality of first ports, and each respective plurality of sub-ports of the plurality of first contour ports is connected, using a respective power splitter, to the respective first port of the plurality of first ports, and wherein for each first port of the plurality of first ports, the corresponding power splitter is disposed between the corresponding first contour port and the respective first port.

14. The feeding device according to claim 13, further comprising:

a plurality of second ports; and wherein the body further comprises a plurality of second contour ports, each second contour port of the plurality of second contour ports corresponds to a respective second port of the plurality of second ports, and each second contour port of the plurality of second contour ports is connected to the respective second port of the plurality of second ports using a respective stepped impedance transformation structure.

15. The feeding device according to claim 14, wherein, for each stepped impedance transformation structure, a length a of each step of impedance structure in the respective stepped impedance transformation structure in a direction in which the corresponding second contour port points to the corresponding second port meets the following:

the length a is a quarter of a wavelength corresponding to a central frequency of an operating frequency band of the feeding device.

16. The feeding device according to claim 14, wherein each stepped impedance transformation structure is a microstrip stepped impedance transformation structure.

17. The feeding device according to claim 14, wherein each stepped impedance transformation structure is a strip line stepped impedance transformation structure.

18. The feeding device according to claim 14, wherein each stepped impedance transformation structure is a coaxial line stepped impedance transformation structure.

19. The feeding device according to claim 14, wherein the body further comprises a redundant port, and the redundant port is disposed between one first contour port of the plurality of first contour ports and one second contour port of the plurality of second contour ports.

20. The feeding device according to claim 13, wherein the body further comprises a redundant port, and the redundant port is disposed between two of the plurality of first contour ports.

* * * * *